United States Patent [19]

Bove et al.

[11] 4,207,077

[45] Jun. 10, 1980

[54] GASOLINE-ETHANOL FUEL MIXTURE SOLUBILIZED WITH METHYL-T-BUTYL-ETHER

[75] Inventors: Francis S. Bove; William M. Sweeney, both of Wappingers Falls; Sheldon Herbstman, Spring Valley, all of N.Y.

[73] Assignee: Texaco Inc., White Plains, N.Y.

[21] Appl. No.: 14,507

[22] Filed: Feb. 23, 1979

[51] Int. Cl.[2] ..... C10L 1/18

[52] U.S. Cl. ..... 44/56; 44/77; 44/53

[58] Field of Search ..... 44/56, 77, 53

[56] References Cited

U.S. PATENT DOCUMENTS

| | | | |
|---|---|---|---|
| 1,361,153 | 12/1920 | Hayes | 44/56 |
| 1,907,309 | 5/1933 | Van Schaack, Jr. | 44/56 |
| 2,046,243 | 6/1936 | Buc | 44/56 |
| 2,643,942 | 6/1953 | Barusch | 44/56 |

*Primary Examiner*—Robert V. Hines
*Assistant Examiner*—J. V. Howard
*Attorney, Agent, or Firm*—Carl G. Ries; Robert A. Kulason; Henry W. Archer

[57] ABSTRACT

Pure methyl-t-butyl ether is used as a cosolvent for hydrous ethanol in gasoline fuel mixtures. The ether solubilizes grain alcohol in all proportions in low aromatics content gasolines.

9 Claims, No Drawings

GASOLINE-ETHANOL FUEL MIXTURE SOLUBILIZED WITH METHYL-T-BUTYL-ETHER

FIELD OF THE INVENTION

This invention relates to novel fuel mixtures for use in internal combustion engines. More particularly, the invention relates to stabilizing ethanol in hydrocarbons boiling in the gasoline range by means of an additive which provides additional octane rating to the resulting blend and has no adverse effect on its storage stability, water-shedding or corrosion properties. The invention also is concerned with a process for stabilizing ethanol in gasolines.

DESCRIPTION OF THE PRIOR ART

Consideration of the use of grain alcohol as an automotive fuel is as old as the internal combustion engine itself. It is reported, for example, in a 1907 U.S. Department of Agriculture report entitled "Use of Alcohol and Gasoline in Farm Engines". Later in 1938, the USDA issued another report entitled "Motor Fuel from Farm Products." Recently, interest has been shown in "Gasohol" a blend of 95% gasoline with 5% of ethanol and in "Alcogas", a blend of 85% gasoline and 15 percent of presumably anhydrous alcohol.

Use of commercial ethanol in gasoline blends can cause phase separation problems because water containing ethanol has limited solubility in gasoline, particularly, in low aromatic content gasolines sold in certain countries which contain 5 to 15 volume percent of aromatics.

Various attempts to solve this solubility problem are described in the publication Hydrocarbon Processing 56 (II) 295–299 (November 1977). The article describes the effect of methyl-t-butyl ether on dry methanol and how methanol solubility relates to the aromatic content of gasoline. More important the article unequivocally states that this ether does not substantially improve the water tolerance of methanol.

OBJECTS AND SUMMARY OF THE INVENTION

One of the principal objects of this invention is to provide an improved fuel composition wherein the gasoline and ethanol components are maintained in a single phase by a cosolvent.

The invention whereby the foregoing and relative objects are attained resides in a fuel comprising a major amount of a gasoline, a minor amount of hydrous ethanol and a cosolvent amount of methyl-t-butyl ether.

In accordance with the present invention, from 4 to 12 volume percent of methyl-t-butyl ether (MTBE) is blended in with a fuel consisting of 70 to 90 volume percent gasoline and 5 to 20 volume percent of 95 percent (or "wet") ethanol. Pure (at least 99 percent purity) MTBE has been found to solubilize grain alcohol in gasoline in all proportions thereby allowing a wide latitude in the precise amount of ethanol which can be blended with the gasoline. In addition, the presence of this material in the blend considerably increases its octane rating.

The invention is generally applicable to hydrocarbon mixtures in the gasoline boiling range of about 90° F. to about 420° F. These mixtures essentially have no lubricity value and are obtained by separating an appropriate boiling fraction from a hydrocarbon distillate obtained in the refining of crude oil.

Processwise, the invention resides in blending using suitable mixing equipment gasoline, ethanol and methyl-t-butyl ether in the above given proportions.

As shown in the tables below the addition of methyl-t-butyl ether (MTBE) will solubilize the water present in grain alcohol when that material is used in gasoline mixtures. The resulting mixtures, in addition to being haze-free, have a higher octane number than the fuel without the MTBE.

TABLE I

SOLUBILITY OF GASOLINE-95% ETOH-MTBE MIXTURES

| Volume, cc. | | | Solubility | |
|---|---|---|---|---|
| Gasoline | 95% ETOH | MTBE | 78° F. | 48° F. |
| 78 | 10 | 12 | Sol. | Sol. |
| 76 | 12 | 12 | Sol. | Sol. |
| 73 | 15 | 12 | Sol. | Sol. |
| 70 | 20 | 10 | Sol. | Sol. |
| 90 | 5 | 5 | Insol. | Insol. |
| 85 | 5 | 10 | Sol. | Insol. |

[1]All gasoline - 95% EtOH mixtures shown in this table are insoluble when MTBE was not present in the fuel.

TABLE II

| | Volume (cc.) | |
|---|---|---|
| Gasoline | 95% EtOH | MTBE[(1)] |
| 82 | 18 | 4 |
| 84 | 16 | 10 |
| 90 | 10 | 12 |

[(1)]MTBE titrated into gasoline-EtOH mix until hazedisappeared.

Minor amount of other additives may optionally be employed in the fuel composition. Such additives may include anti-oxidants such as ethylene diamine, hindered phenols and others well known in the art.

Obviously, many modifications and variations of the invention as hereinbefore set forth may be made without departing from the spirit and scope thereof and therefore only such limitations should be imposed thereon as are indicated in the appended claims.

What is claimed is:

1. In a (A) fuel consisting essentially of a major amount of gasoline, a minor amount of hydrous ethanol, the improvement consisting of adding a co-solvent amount of substantially pure methyl-t-butyl ether sufficient to render said fuel haze-free.

2. The fuel of claim 1, comprising from 70 to 90 volume percent of gasoline, 5 to 20 volume percent of hydrous ethanol and 4 to 12 volume percent of methyl-t-butyl ether.

3. The fuel of claim 1, wherein said methyl-t-butyl ether is at least 99 percent pure.

4. The fuel of claim 1, wherein said ethanol contains about 5 volume percent of water.

5. The fuel of claim 1, containing also an antioxidant.

6. A process for stabilizing hydrous ethanol in gasoline which comprises adding to a gasoline and ethanol mixture a cosolvent amount of methyl-t-butyl ether sufficient to cause disappearance of haze in said mixture.

7. The process of claim 6, wherein the amount of ethanol ranges from 5 to 20 volume percent and said amount of ether ranges from 4 to 12 volume percent.

8. The process of claim 6, wherein said gasoline contains from 5 to 15 volume percent of aromatics.

9. The fuel of claim 1, wherein said gasoline contains from 5 to 15 volume percent of aromatics.

* * * * *